US006823993B1

(12) United States Patent
Cruze

(10) Patent No.: US 6,823,993 B1
(45) Date of Patent: Nov. 30, 2004

(54) STORAGE DEVICE FOR DECORATIVE LIGHT STRANDS

(76) Inventor: Nicole L. Cruze, 4816-B Handrich St., Wahiawa, HI (US) 96786

( * ) Notice: Subject to any disclaimer, the term of this patent is extended or adjusted under 35 U.S.C. 154(b) by 3 days.

(21) Appl. No.: 10/369,478

(22) Filed: Feb. 20, 2003

(51) Int. Cl.[7] ..... B65D 85/42
(52) U.S. Cl. ..... 206/419; 206/702
(58) Field of Search ..... 206/418, 419, 206/420, 408, 702, 806; 211/26, 113, 115, 117

(56) References Cited

U.S. PATENT DOCUMENTS

| | | | | | |
|---|---|---|---|---|---|
| D341,291 | S | * | 11/1993 | Dow, III | D7/376 |
| 5,653,339 | A | * | 8/1997 | Dobson | 206/420 |
| 6,360,891 | B1 | * | 3/2002 | Rideout | 206/373 |
| 6,467,623 | B1 | * | 10/2002 | Lewis et al. | 206/575 |
| 6,676,069 | B1 | * | 1/2004 | Davis | 242/609.1 |

* cited by examiner

*Primary Examiner*—Shian T. Luong

(57) ABSTRACT

The storage device for decorative light strands is a storage unit designed to house strands of decorative lights such as those used for Christmas and other holidays. This unit provides a convenient means through which the lights can be safely stored without the strands breaking or becoming entangled. The storage device consists of a cylindrical receptacle with a locking lid featuring a handle and from which extrudes a cylindrical core. The strands of lights would be wound on to the core, which can be rotated when the handle on the lid is pushed downward and turned. A trio of hooks attached to the bottom of the core would ensure that the lights remained securely in place. Three elastic bands attached to the underside of the lid would be stretched across the lights and attached to the hooks to securely hold the lights. The lid would then be locked in place on the storage receptacle using incorporated locking clips. This unit would make decorating more enjoyable, eliminating the wasted time and frustration associated with untangling strands of lights or locating and replacing lights which have been broken due to improper storage.

19 Claims, 4 Drawing Sheets

STORAGE DEVICE FOR DECORATIVE LIGHT STRANDS

BACKGROUND OF THE INVENTION

1. Field of the Invention

The present invention relates to a storage device for use in connection with decorative light strands. The storage device for decorative light strands has particular utility in connection with safely and conveniently housing decorative lights to avoid breakage and entanglement.

2. Description of the Prior Art

Strands of decorative lights are becoming more popular than ever, with different colored strands available for St. Patrick's Day, Easter, Independence Day, Halloween, Christmas, and other holidays. These types of lights typically include an elongated electrical conductor-pair cord with multiple electric lights connected along the cord at equally spaced intervals. Electrical plugs are connected at each end, allowing multiple strands to be serially connected with one end of the connected light strings available for insertion into a source of electrical power. Storage of these light strands presents a problem for many decorators. Decorative light strands are typically packaged in flat rectangular cardboard boxes with the lights wrapped around plastic or cardboard inserts. Once the lights have been removed from their initial packaging, reusing the packaging is close to impossible. Rewinding the lights into the exact configuration in which they were initially packaged presents a formidable task that is extremely tedious and time consuming. Moreover, the lights are typically twisted and do not lie flat, making it difficult to fit the lights in their original boxes. Moreover, these cardboard boxes are typically flimsy and easily crushed or torn, providing little protection for the lights when stored with other decorations. Other means for storing the devices have led to tangled strands and broken lights. Untangling the strands can be both frustrating and time consuming, and any excessive force applied to the process can damage the light strands. Therefore, a storage device which allows the user to easily and safely store the light strands without breakage or tangling of the strands would save time and energy, as well as eliminating frustration and adding to the enjoyment of the decorating process.

A further problem associated with decorative light strands is storage space. These decorative lights are typically used only once a year, so they must be placed in storage for a majority of the year. Since a large number of light strands are typically used both inside and outside the dwelling or business establishment, a feature allowing multiple such storage devices to be stacked would allow the user to efficiently store the strands without breaking the lights.

New types of lighting strands include swag, icicle, and net styles, which present a new set of storage problems for the decorator. Typical storage devices allow for the strands to be wrapped around a lattice or cylindrical post and then inserted into a storage receptacle. However, these new varieties of light strands have secondary strands which hang below the main light strand. Many of these storage devices make no provision for allowing these secondary strands to hang below the main strand, instead allowing these secondary strands to become entangled with each other or with the main strand. Untangling these secondary strands can be time consuming and lead to frustration for the decorator. Additionally, any excessive force applied to the untangling process can damage the electrical cord to which the lights are attached. Therefore, a storage device which allows the secondary strands of these newer varieties of lighting strands to hang below the main light strand without becoming entangled would save time and eliminate the frustration associated with decorating with these light strands.

The use of storage devices for decorative light strings is known in the prior art. For example, U.S. Pat. No. 5,381,899 to Mary M. Rabbitt discloses a package for storing decorative lights that includes an elongated cylindrical core with notches in the ends and a protective cylindrical outer cover. The light strands are wound around the exterior of the core, with the electrical connector plugs extending through the notches, after which the cover is placed over the core. However, the Rabbitt '899 patent makes no provision for allowing secondary strands of decorative lights, such as icicle, net, and swag style lights, to hang below the main strand without becoming entangled. Additionally, since the Rabbitt '899 device is cylindrical and does not provide a cap, and thus no flat surface, for either end of the cylinder, it would not be suitable for stacking. Although different embodiments of the Rabbitt '899 device provide various geometrical shapes for the external cover, these devices still provide no end caps for the cover, reducing the supporting strength of the cover and leaving the lights at either end open to damage if tightly packed in an attic or closet. Therefore, the Rabbitt '899 device would not prove to be a safe and efficient way to store multiple light strands.

U.S. Pat. No. 5,287,965 to John E. Miller discloses a light storage device made of corrugated cardboard and consisting of a vertical core around which the lights are wound and a rectangular carton into which the wound lights are then placed. However, the Miller '965 patent makes no provision for effectively storing lights strands such as icicle, net, and swag styles without allowing their secondary strands to become entangled with the main strand. Additionally, the Miller '965 patent suggests the container be made from corrugated cardboard, leaving it susceptible to being torn or smashed and damaging the contained lights if other decorations are stored on top of the device.

Similarly, U.S. Pat. No. Des. 341, 291 to Leo F. Dow discloses the ornamental design for a stirring pot that contains a cylindrical pot with a lid having two cross shaped stirring members suspended from its center. However, the Dow '291 patent does not provide a central cylindrical core that is sufficient for having lights wound around it. Additionally, the configuration of the multiple stirring members of the Dow '291 device would make it tedious and time consuming to wind the light strand around and between each extension. Finally, the Dow '291 device does not have a flat top surface onto which a second device could be stacked, eliminating the possibility of using the Dow '291 device for efficiently storing multiple light strands.

U.S. Pat. No. 5,676,250 to Darryl Kurt Walters discloses a light string mounting storage system for storing a light string and removably coupling the light string to a building. The device includes an elongated hollow tube about which a light string can be wound and hook and loop fasteners for securing the light string to the exterior of the tube. However, the Walters '250 patent does not provide a means for storing icicle, net, and swag style lights without exposing the secondary strands of these lights to entanglement. Furthermore, due to the elongated nature of the Walters '250 device, it would not provide a stable base upon which another of the same device could be stacked. Therefore, the Walters '250 device would not serve as a stable and efficient means for storing multiple light strands.

Likewise, U.S. Pat. No. 5,033,619 to Cynthia L. Garis discloses a light string carrier that includes a lattice around which a light string may be wrapped, a carrying handle atop the lattice, and a hinged two-part carrier cover that fits over the lattice and allows the handle to protrude through the top. However, the Garis '619 patent makes no provision for allowing secondary strands of decorative lights, such as icicle, net, and swag style lights, to hang below the main strand without becoming entangled. Additionally, the configuration of the storage receptacle of the Garis'619 device is such that the sides slope inward from the top to the bottom, thus the device provides a sloped surface unsuitable for stacking purposes.

Lastly, U.S. Pat. No. 5,653,339 to Alicia A. Dobson discloses a storage receptacle for Christmas lights and accessories that consists of multiple rectangular lattice members with handles around which the lights may be wound and a rectangular storage receptacle with lid in which multiple lattices may be suspended by inserting the terminal end of each lattice member handle into slots formed in the top edges of opposing walls of the storage receptacle. However, the Dobson '339 patent makes no provision for effectively storing lights strands such as icicle, net, and swag styles without allowing their secondary strands to become entangled with the main strand. Furthermore, if the Dobson '339 device is placed on its side for storage, movement of the lattices is likely, leading to possible breakage of light bulbs in the light strands.

While the above-described devices fulfill their respective, particular objectives and requirements, the aforementioned patents do not describe a storage device for decorative light strands that allows a user to safely and efficiently store decorative light strands to avoid breakage and entanglement, especially of secondary light strands with the main strand. The Rabbitt '899, Miller '965, Walters '250, Garis '619, and Dobson '339 patents make no provision for allowing secondary strands of decorative lights, such as icicle, net, and swag style lights, to hang below the main strand without becoming entangled. Additionally, the Rabbitt '899, Dow '291, Walters '250, and Garis '619 devices are not suitably configured for stacking multiple units for efficient storage of a plurality of light strands. Furthermore, the suggestion that the Miller '965 device be made from corrugated cardboard, leaves it susceptible to being torn or smashed and damaging the contained lights if other decorations are stored on top of the device. In addition, if the Dobson '339 device is placed on its side for storage, movement of the lattices is likely, leading to possible breakage of light bulbs in the light strands. Finally, the Dow '291 device does not provide a central core suitable for supporting wound lights, and the multiple stirring members would make winding lights on this device tedious and time consuming.

Therefore, a need exists for a new and improved storage device for decorative light strands that safely stores decorative light strands to avoid breakage and entanglement and provides a stackable container that allows efficient storage of the light strands. In this regard, the present invention substantially fulfills this need. In this respect, the storage device for decorative light strands according to the present invention substantially departs from the conventional concepts and designs of the prior art, and in doing so provides an apparatus primarily developed for the purpose of safely and conveniently housing decorative lights to avoid breakage and entanglement.

SUMMARY OF THE INVENTION

In view of the foregoing disadvantages inherent in the known types of storage devices for decorative light strings now present in the prior art, the present invention provides an improved storage device for decorative light strands, and overcomes the above-mentioned disadvantages and drawbacks of the prior art. As such, the general purpose of the present invention, which will be described subsequently in greater detail, is to provide a new and improved storage device for decorative light strands and method which has all the advantages of the prior art mentioned heretofore and many novel features that result in a storage device for decorative light strands which is not anticipated, rendered obvious, suggested, or even implied by the prior art, either alone or in any combination thereof.

To attain this, the present invention essentially comprises a cylindrical storage receptacle with a locking lid having a handle on top and a cylindrical core extruding from the bottom and on to which decorative light strands can be wound. The lid contains a rubber seal with which the handle can be locked or can be slid downwards for rotating the core for playing out the light strand or winding the lights onto the core. A plurality of J-shaped hooks protrudes from the bottom of the core to help retain the lights on the core.

There has thus been outlined, rather broadly, the more important features of the invention in order that the detailed description thereof that follows may be better understood and in order that the present contribution to the art may be better appreciated.

The invention may also include a plurality of elastic bands connected to the bottom of the lid which attach to the hooks and help secure the light strands on the core. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved storage device for decorative light strands that has all of the advantages of the prior art storage devices for decorative light strings and none of the disadvantages.

It is another object of the present invention to provide a new and improved storage device for decorative light strands that may be easily and efficiently manufactured and marketed.

An even further object of the present invention is to provide a new and improved storage device for decorative light strands that has a low cost of manufacture with regard to both materials and labor, and which accordingly is then susceptible of low prices of sale to the consuming public, thereby making such a storage device for decorative light strands economically available to the buying public.

Still another object of the present invention is to provide a new storage device for decorative light strands that provides in the apparatuses and methods of the prior art some of the advantages thereof, while simultaneously overcoming some of the disadvantages normally associated therewith.

Even still another object of the present invention is to provide a storage device for decorative light strands for safely and conveniently housing these lights to avoid breakage and entanglement. This allows the decorator to use and store these lights quickly and efficiently without spending an undue amount of time untangling the lights or replacing bulbs broken during improper storage.

Yet another object of the present invention is to provide a storage device for decorative light strands that allows the strands to be directly wound onto or unwound from the storage device. This simplifies the decorating process, providing the decorator with a safe method of containing the strands while placing them on or removing them from the desired location and leading to a more enjoyable decorating experience.

Even yet another object of the present invention is to provide a storage device for decorative light strands that provides a secure means for holding the lights against the cylinder upon which they are wound. This keeps the lights from slipping from the cylinder due to gravity during lengthy storage and gives the owner peace of mind that the strands will not be damaged due to movement.

Still yet another object of the present invention is to provide a storage device for decorative light strands that provides a receptacle for successfully storing new types of decorative lights with secondary strands, such as icicle, net, and swag styles. This allows these new styles of decorative lights to be stored without the secondary strands becoming entangled with the main strand.

Lastly, it is an object of the present invention to provide a new and improved storage device for decorative light strands that is capable of being stacked upon another such storage device. This allows the decorator to efficiently store multiple strands of lights using the minimum amount of space while ensuring that the lights will not be damaged or become entangled.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
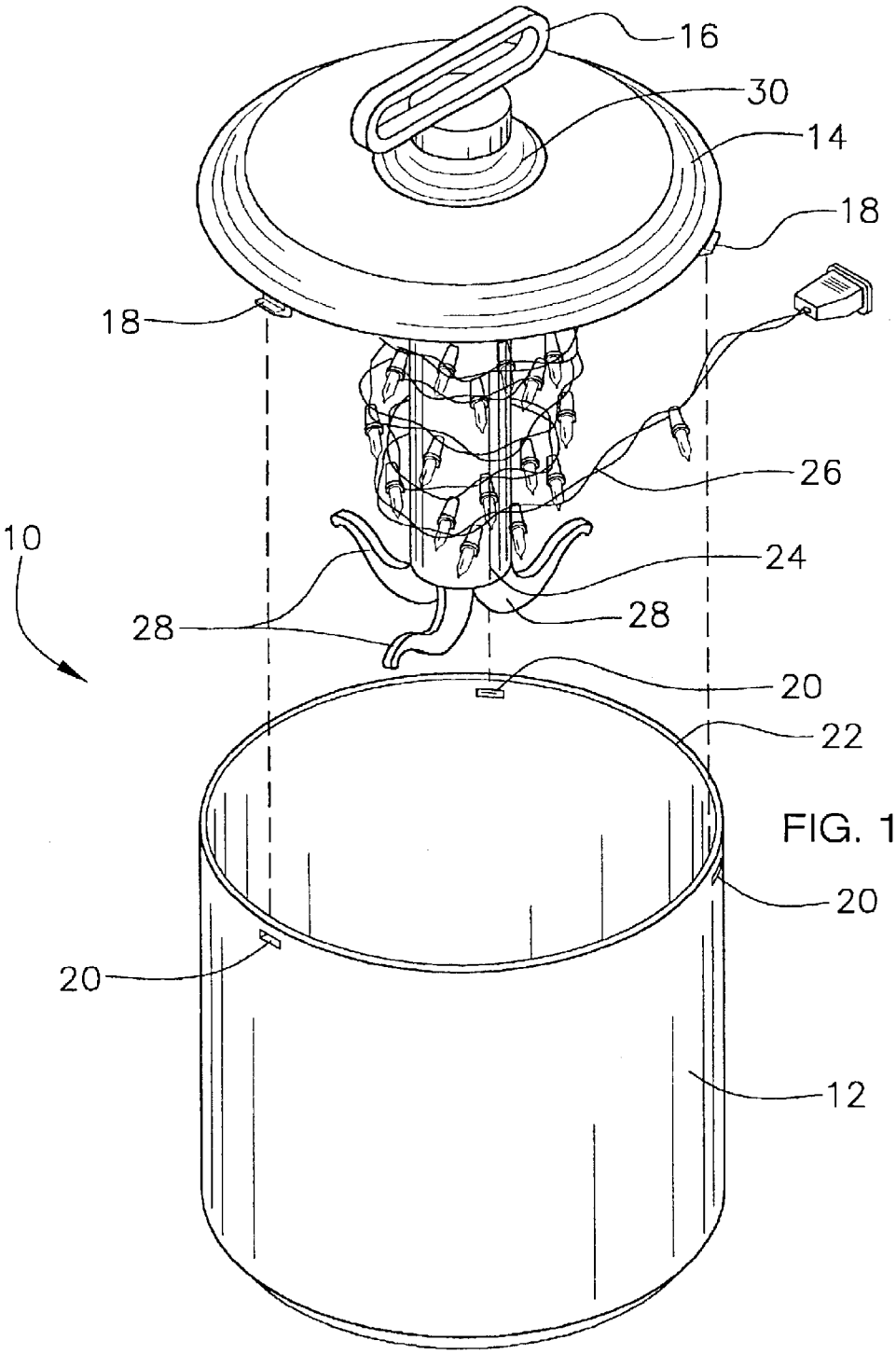
FIG. 1 is a front perspective view of the preferred embodiment of the open storage device for decorative light strands constructed in accordance with the principles of the present invention.

Referring now to the drawings, and particularly to FIGS. 1-4, a preferred embodiment of the storage device for decorative light strands of the present invention is shown and generally designated by the reference numeral 10.

Figure 2:
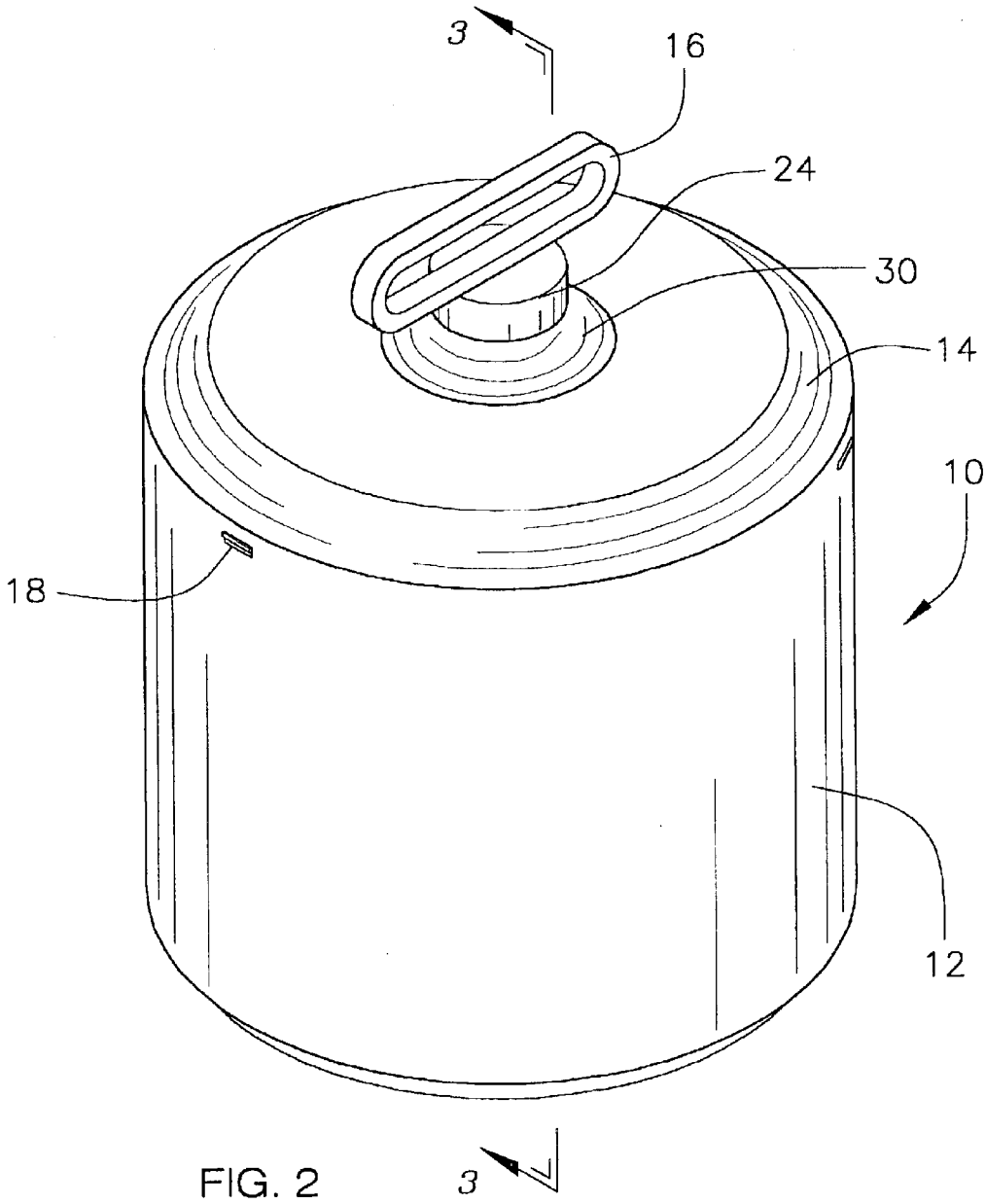
FIG. 2 is a front perspective view of the closed storage device for decorative light strands of the present invention.

In FIGS. 1 and 2, a new and improved storage device for decorative light strands 10 of the present invention for safely and conveniently housing decorative lights to avoid breakage and entanglement is illustrated and will be described. More particularly, the storage device for decorative light strands 10 has a cylindrical storage receptacle 12 and a hollow lid 14 with a handle 16 and locking clips 18. The locking clips 18 fit into locking slots 20 cut into the upper edge 22 of the storage receptacle 12. The underside of the lid 14 has a cylindrical core 24, upon which strands of decorative lights 26 are wound, extruding downward from its center. A trio of upwardly angled hooks 28 is attached to the bottom of the core 24 to keep the lights 26 from slipping off the bottom of the core 24. The lid 14 also features a rubber seal 30 which can be pushed into the hollow of the lid 14 with the handle 16 so that the core 24 can be rotated for easier winding and unwinding of the light strands. This feature could aid the user when removing the lights 26 from a tree or house or when placing the lights 26 in their desired location. The handle 16 is locked into place during storage of the lights 26. Both the storage receptacle 12 and the lid 14 could be made of plastic for lightweight storage.

Figure 3:
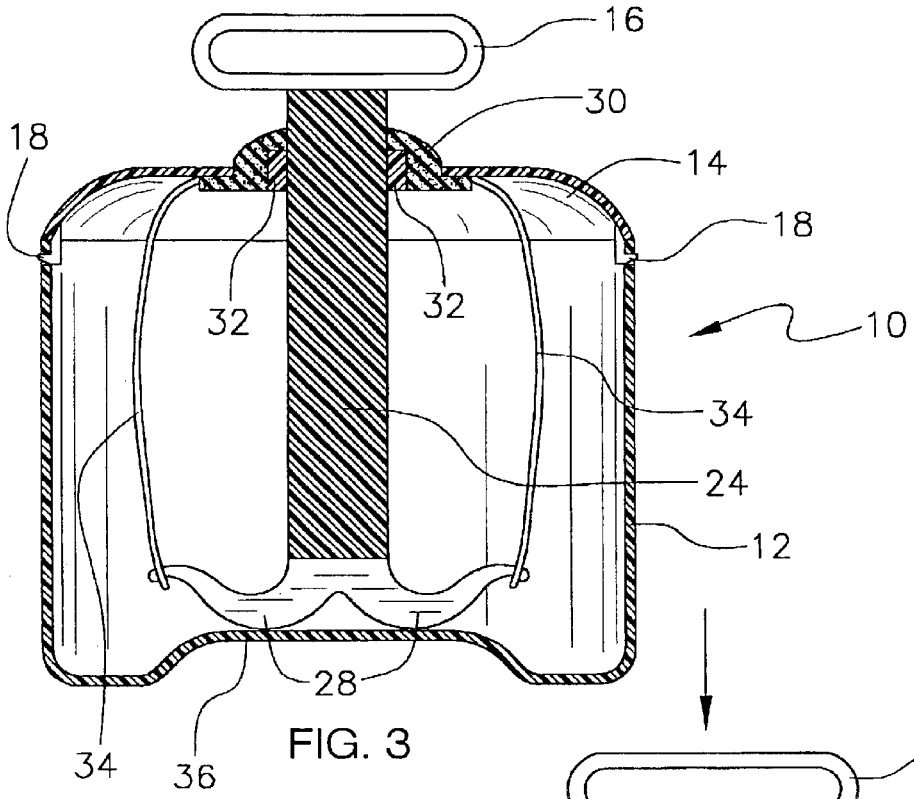
FIG. 3 is a front cross sectional view of the closed storage device for decorative light strands of the present invention taken along a longitudinal axis.
Figure 4:
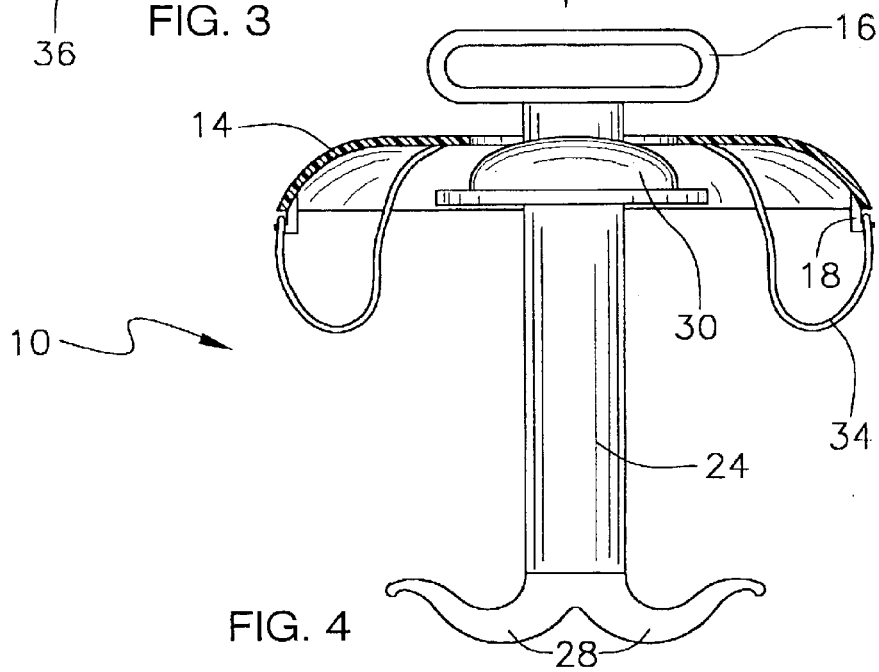
FIG. 4 is a front cross sectional view of the lid of the storage device for decorative light strands of the present invention.

FIGS. 3 and 4 show a front cross sectional views of the storage device for decorative light strands 10 of the present invention. FIG. 3 shows the sleeve 32 cut into the underside of the lid 14 that allows the core 24 to rotate when the handle 16 is turned. Elastic straps 34 extend from the bottom the lid 14 and are removably attached to the hooks 28 to securely hold the lights 26 against the core 24. The straps 34 can be attached to the locking clips 18 on the lid 14 when they are not being used. FIG. 4 shows the nature of the downwardly mobile rubber seal 30 that allows the core 24 to be rotated to facilitate decoration with and retrieval of the lights 26. The bottom of the storage receptacle 12 is formed with a concave depression 36 that allows multiple units to be stacked on top of each other. The height of the receptacle 12 will be approximately ½ inch longer than the core 24 for normal strands of lights 26.

Figure 5:
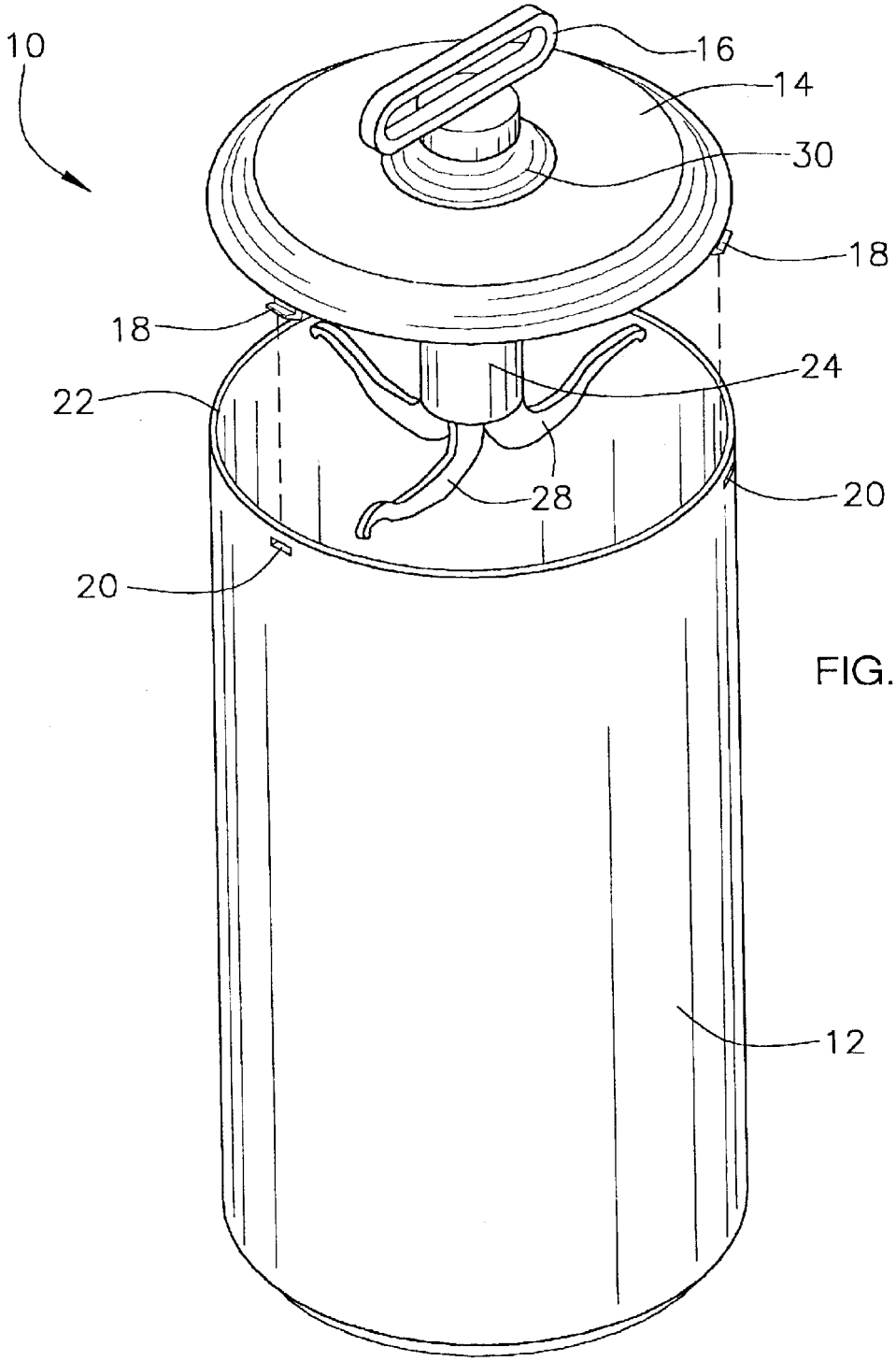
FIG. 5 is a front perspective view of the second embodiment of the storage device for decorative light strands of the icicle, swag, and net variety.

FIG. 5 shows a front perspective view of the second embodiment of the storage device for decorative light strands of the icicle, swag, and net variety. The core 24 would be shortened, and the storage receptacle 12 would be approximately 8 inches longer than the core 24 for the newer icicle, net, and swag styles of lights 26. The hooks 28 would also be lengthened for the newer light styles.

In use, it can now be understood that that the decorator would remove the strands of lights 26 from a tree or house by removing the lid 14, unlocking the handle 16, and rotating the core 24 as the lights 26 are wound on to it. Once the entire strand of lights 26 was wound onto the core, one elastic strap 34 would be affixed to each of the hooks 28. The handle 16 would then be locked into place, and the lid 14 would be affixed to the storage receptacle 12 by inserting the locking clips 18 into the locking slots 20 in the upper edge 22 of the storage receptacle 12. Multiple strands of lights 26 could then be stored in a similar fashion in multiple units. Once the decorator had removed all of the lights 26, the storage devices 10 could be stacked in the storage area by fitting the handle 16 of the bottom device 10 into the concave depression 38 of the device 10 placed on top of it. When the decorator is ready to use the lights 26, the reverse procedure could be followed.

While a preferred embodiment of the storage device for decorative light strands has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as metal, PVC, heavy duty cardboard, or a variety of wood may be used instead of plastic lid and storage receptacle described. Also, the hooks could be made of any sturdy material such as metal, PVC, plastic heavy duty cardboard, a variety of wood, or heavy duty rubber. And although safely and conveniently housing decorative lights to avoid breakage and entanglement have been described, it should be appreciated that the storage device for decorative light strands herein described is also suitable for storing any type of cords or hoses, such as telephone cords, power cords, extension cords, stretch exercise cords, garden hoses, and other types of cables and hoses.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A storage device for decorative light strands comprising:

a storage receptacle having an open top, a bottom, an exterior surface with an upper edge along said open top and formed with a plurality of radial slots near said upper edge, and an interior surface formed by a hollow interior;

a domed lid having a top exterior surface joined to a bottom interior surface by an outer edge, a plurality of locking clips extending outward from said interior surface past said outer edge and spaced in the same manner as said radial slots in said storage receptacle, and a center formed with a transverse aperture and removably connected to said upper edge of said storage receptacle wherein said locking clips snap into said radial slots in said upper edge of said storage receptacle and hold said lid to said storage receptacle until said clips are pushed downward to release said lid from said storage receptacle;

a rubber seal having a circular base with a top surface and a bottom surface and a domed top having an exterior surface and an interior and slideably connected to said center of said lid wherein said seal is inserted into said aperture in said center of said lid and is capable of downward movement in said aperture; a handle a cylindrical core having a top surface, a side surface, and a bottom surface and said handle is connected to said top surface of said core; said core connected on said side surface to said interior of said rubber seal wherein said core extends downward from said handle;

a plurality of hooks connected to said bottom surface of said core wherein said hooks are angled upward toward said bottom interior surface of said lid.

2. The storage device for decorative light strands of claim 1 wherein said storage receptacle is cylindrical.

3. The storage device for decorative light strands comprising of claim 2 wherein said outer edge of said lid is circular and has the same diameter as said cylindrical storage receptacle.

4. The storage device for decorative light strands of claim 1 wherein said storage receptacle has a height slightly longer than the length of said core for storing regular decorative light strands.

5. The storage device for decorative light strands of claim 1 wherein said storage receptacle has a height sufficiently longer than the length of said core wherein the secondary icicle strands of icicle style decorative lights can dangle unencumbered when said icicle style decorative lights are wound around said core.

6. The storage device for decorative light strands of claim 1 wherein said rubber seal is formed with a first transverse cylindrical aperture passing through said base into said interior of said domed top and a second transverse aperture concentrically extending from said first transverse aperture through said exterior surface of said domed top wherein said first and said second apertures have diameters slightly larder than the diameter of said core.

7. The storage device for decorative light strands of claim 6 wherein said core extends downward through said first and said second apertures in said rubber seal wherein said handle is above said rubber seal and said plurality of hooks is below said rubber seal and said core is able to rotate within said first and second apertures when said handle is turned.

8. The storage device for decorative light strands of claim 1 wherein said bottom of said storage receptacle is formed with a concave depression wherein a first said storage device can be stacked on top of a second said storage device with said handle of said second said storage device contained within said concave depression of said bottom of said first storage device.

9. The storage device for decorative light strands of claim 1 wherein said handle is formed with an opening through which the fingers of a hand can fit for gripping purposes.

10. The storage device for decorative light strands of claim 1 wherein each said hook is spaced equidistant from each adjacent said hook.

11. A storage device for decorative light strands comprising:

a storage receptacle having an open top, a bottom, an exterior surface with an upper edge along said open top and formed with a plurality of radial slots near said upper edge, and an interior surface formed by a hollow interior;

a domed lid having a top exterior surface joined to a bottom interior surface by an outer edge, a plurality of locking clips extending outward from said interior surface past said outer edge and spaced in the same manner as said radial slots in said storage receptacle, and a center formed with a transverse aperture and removably connected to said upper edge of said storage receptacle wherein said locking clips snap into said radial slots in said upper edge of said storage receptacle and hold said lid to said storage receptacle until said clips are pushed downward to release said lid from said storage receptacle;

a rubber seal having a circular base with a top surface and a bottom surface and a domed top having an exterior surface and an interior and slideably connected to said center of said lid wherein said seal is inserted into said aperture in said center of said lid and is capable of downward movement in said aperture; a handle a cylindrical core having a top surface, a side surface, and a bottom surface and said handle is connected to said top surface of said core; said core connected on said side surface to said interior of said rubber seal wherein said core extends downward from said handle;

a plurality of hooks connected to said bottom surface of said core wherein said hooks are angled upward toward said bottom interior surface of said lid; and a plurality of elastic bands having a top end and a bottom end formed with a loop and connected on said top end to said bottom interior surface of said lid and removably connected on said bottom end to said hooks wherein each said band is connected at said loop on said bottom end of said band to a different said hook.

12. The storage device for decorative light strands of claim 11 wherein said storage receptacle is cylindrical.

13. The storage device for decorative light strands comprising of claim 12 wherein said outer edge of said lid is circular and has the same diameter as said cylindrical storage receptacle.

14. The storage device for decorative light strands of claim 11 wherein said storage receptacle has a height slightly longer than the length of said core for storing regular decorative light strands.

15. The storage device for decorative light strands of claim 11 wherein said storage receptacle has a height sufficiently longer than the length of said core wherein the secondary icicle strands of icicle style decorative lights can dangle unencumbered when said icicle style decorative lights are wound around said core.

16. The storage device for decorative light strands of claim 11 wherein said rubber seal is formed with a first transverse cylindrical aperture passing through said base into said interior of said domed top and a second transverse aperture concentrically extending from said first transverse aperture through said exterior surface of said domed top wherein said first and said second apertures have diameters slightly larger than the diameter of said core.

17. The storage device for decorative light strands of claim 16 wherein said core extends downward through said first and said second apertures in said rubber seal wherein said handle is above said rubber seal and said plurality of hooks is below said rubber seal and said core is able to rotate within said first and second apertures when said handle is turned.

18. The storage device for decorative light strands of claim 11 wherein said bottom of said storage receptacle is formed with a concave depression wherein a first said storage device can be stacked on top of a second said storage device with said handle of said second said storage device contained within said concave depression of said bottom of said first storage device.

19. The storage device for decorative light strands of claim 11 wherein each said hook is spaced equidistant from each adjacent said hook.

* * * * *